US005507378A

United States Patent [19]

Leone

[11] Patent Number: 5,507,378

[45] Date of Patent: Apr. 16, 1996

[54] COIN BOX RECEPTACLE

[75] Inventor: Michael A. Leone, E. Islip, N.Y.

[73] Assignee: Tricom Corporation, Quoque, N.Y.

[21] Appl. No.: 333,672

[22] Filed: Nov. 3, 1994

[51] Int. Cl.[6] ..... G07F 9/06

[52] U.S. Cl. ..... 194/202; 194/350; 232/15

[58] Field of Search ..... 194/202, 350; 232/15, 16; 70/DIG. 49, 53

[56] References Cited

U.S. PATENT DOCUMENTS

| | | | |
|---|---|---|---|
| Re. 29,511 | 1/1978 | Rubenstein . | |
| D. 336,860 | 6/1993 | Clough | D10/42 |
| D. 342,209 | 12/1993 | Clough | D10/42 |
| 3,102,624 | 9/1963 | Heywood | 194/225 |
| 3,118,597 | 1/1964 | White | 232/1 |
| 3,126,995 | 3/1964 | Kissinger et al. | 194/225 |
| 3,148,826 | 10/1964 | Wilton et al. | 232/1 |
| 3,153,469 | 10/1964 | McPherson | 194/209 |
| 3,204,438 | 10/1965 | Sollenberger | 70/417 |
| 3,231,180 | 1/1966 | Wellekens | 232/15 |
| 3,353,743 | 11/1967 | Amundsen | 232/15 |
| 3,419,209 | 12/1968 | Munn | 232/1 |
| 3,770,090 | 11/1973 | Fayling et al. | 194/350 |
| 3,920,112 | 11/1975 | Guillot | 194/335 |
| 3,930,363 | 1/1976 | Rubenstein . | |
| 3,961,744 | 6/1976 | Kashuba, Jr. | 232/16 |
| 3,964,590 | 6/1976 | May et al. | 194/227 |
| 3,970,182 | 7/1976 | Kiehl et al. | 194/227 |
| 3,998,307 | 12/1976 | Kolben et al. | 194/212 |
| 3,999,372 | 12/1976 | Welch et al. . | |
| 4,183,205 | 1/1980 | Kaiser . | |
| 4,194,775 | 3/1980 | Shea | 292/307 |
| 4,195,471 | 4/1980 | Verhoeven | 368/90 |
| 4,228,519 | 10/1980 | Pfeifer | 364/900 |
| 4,297,683 | 10/1981 | Roberts | 340/539 |
| 4,310,890 | 1/1982 | Trehn et al. | 364/467 |
| 4,546,345 | 10/1985 | Naito | 70/DIG. 49 |
| 4,607,739 | 8/1986 | Kaiser | 194/227 |
| 4,717,007 | 1/1988 | Van Horn | 194/343 |
| 4,729,509 | 3/1988 | Diekhoff | 232/16 |
| 4,730,285 | 3/1988 | Lie | 368/90 |
| 4,786,787 | 11/1988 | Nawada et al. | 235/381 |
| 4,792,032 | 12/1988 | Shapiro | 194/243 |
| 4,798,273 | 1/1989 | Ward, II | 194/350 |
| 4,807,737 | 2/1989 | Herrmann et al. | 194/293 |
| 4,812,805 | 3/1989 | Lachat et al. | 340/825.05 |
| 4,823,928 | 4/1989 | Speas | 194/217 |
| 4,827,206 | 5/1989 | Speas | 323/299 |
| 4,829,296 | 5/1989 | Clark et al. | 340/825.31 |
| 4,847,776 | 7/1989 | Huang | 364/467 |
| 4,848,556 | 7/1989 | Shah et al. | 194/212 |
| 4,861,971 | 8/1989 | Chan | 235/384 |

(List continued on next page.)

FOREIGN PATENT DOCUMENTS

| | | | |
|---|---|---|---|
| 3404185 | 8/1985 | Germany | 194/350 |

*Primary Examiner*—F. J. Bartuska
*Attorney, Agent, or Firm*—Alfred M. Walker

[57] ABSTRACT

A parking meter coin box receptacle retrofits into an existing parking meter while increasing the interior volume of the coin box receptacle, so that more coins can be accumulated between periodic emptying of the box. Moreover, the coin box receptacle includes an exterior display portion to hold a seal, in a secure visible position for locking with a bore within an interior rod within the receptacle. A fastener is in positional register with the seal, and a bore within the fastener accommodates a fiber optic strand within the seal fastener, to hold the locking rod in place and to indicate tampering when the fiber optic strand is cut. The exterior display portion of the coin box receptacle includes an outwardly facing window, so that the bar code on the seal fastener can be easily viewed while the seal fastener is in place in a locked position. An alternate coin box receptacle includes a mount for insertion of the receptacle into a parking meter, wherein vertical wall plates are placed within the parking meter head housing to facilitate a smooth sliding insertion of the coin box receptacle within the parking meter housing head. In addition, to further facilitate the insertion of the receptacle, the round door plate, instead of rotating down, is first moved forward upon a movable track, and then rotated horizontally to facilitate the insertion of the receptacle.

9 Claims, 11 Drawing Sheets

U.S. PATENT DOCUMENTS

| | | | |
|---|---|---|---|
| 4,872,149 | 10/1989 | Speas | 368/90 |
| 4,876,540 | 10/1989 | Berthon et al. | 340/932.2 |
| 4,880,097 | 11/1989 | Speas | 194/239 |
| 4,881,631 | 11/1989 | Ward, II | 194/228 |
| 4,895,238 | 1/1990 | Speas | 194/319 |
| 4,967,895 | 11/1990 | Speas | 194/200 |
| 4,986,406 | 1/1991 | Winsor | 194/350 |
| 5,016,745 | 5/1991 | Schoeb et al. | 194/346 |
| 5,029,094 | 7/1991 | Wong | 364/467 |
| 5,065,156 | 11/1991 | Bernier | 340/932.2 |
| 5,088,073 | 2/1992 | Speas | 368/90 |
| 5,103,957 | 4/1992 | Ng et al. | 194/217 |
| 5,109,972 | 5/1992 | Van Horn et al. | 194/217 |
| 5,131,516 | 7/1992 | Clough | 194/205 |
| 5,135,096 | 8/1992 | Ward, II | 194/224 |
| 5,166,680 | 11/1992 | Ganot | 340/932.2 |
| 5,184,707 | 2/1993 | Van Horn et al. | 194/204 |
| 5,218,892 | 6/1993 | Napoli | 81/440 |
| 5,244,070 | 9/1993 | Carmen et al. | 194/319 |
| 5,259,491 | 11/1993 | Ward, II | 194/350 |
| 5,263,565 | 11/1993 | Wilkinson | 194/216 |

Fig. 9
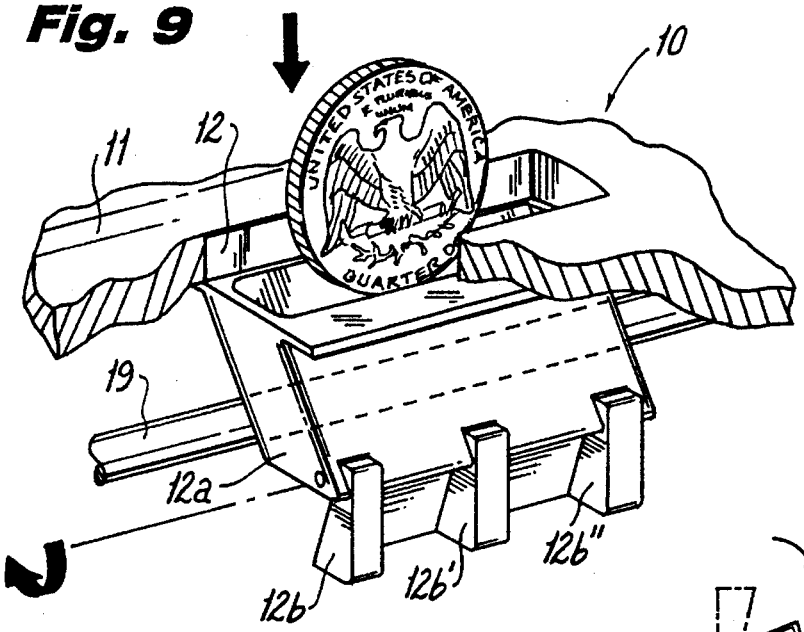
Fig. 10
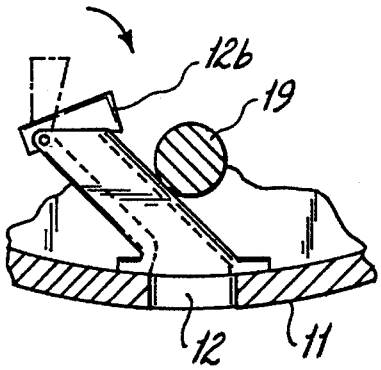
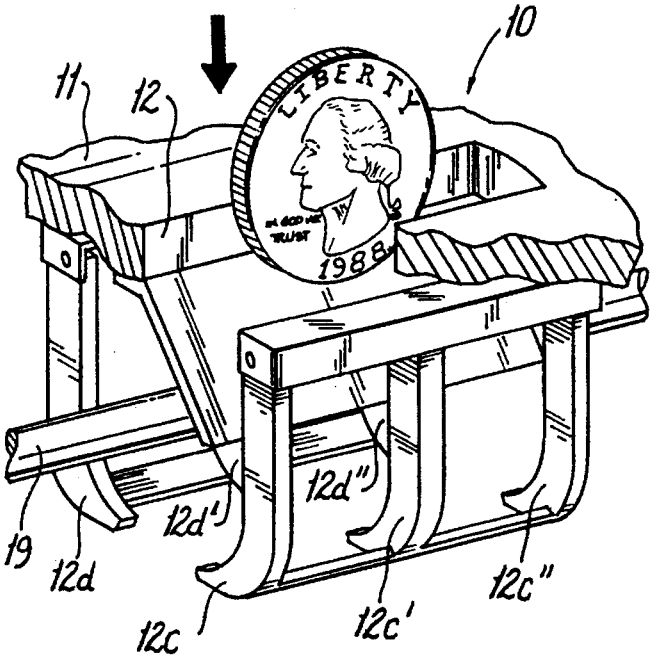
Fig. 11
Fig. 12
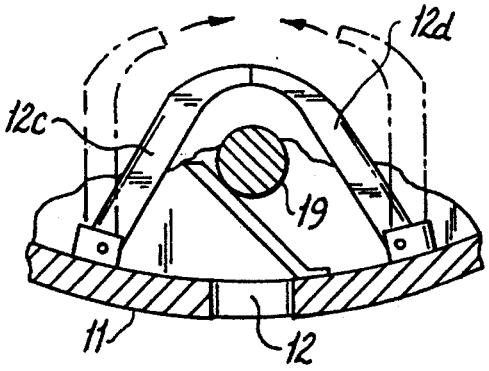

Fig. 17
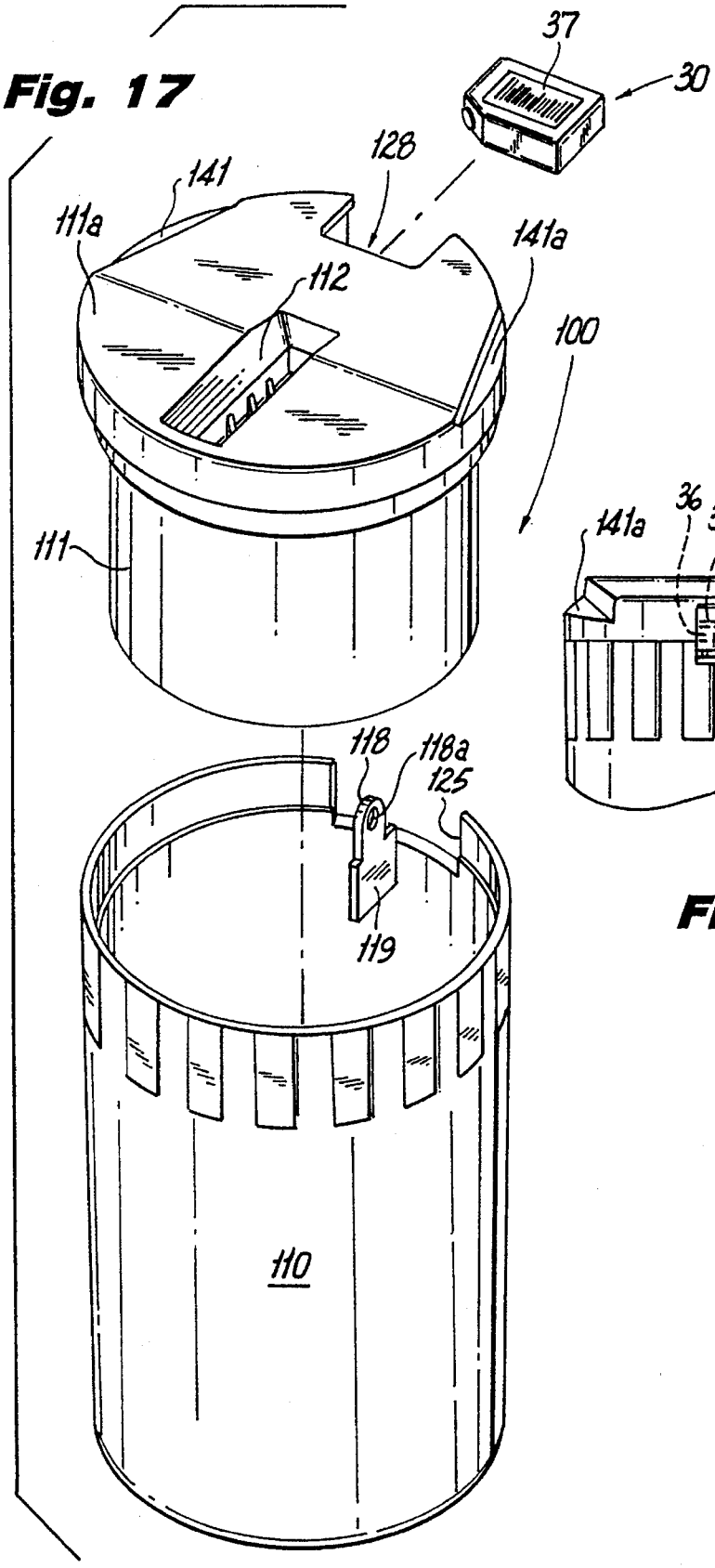
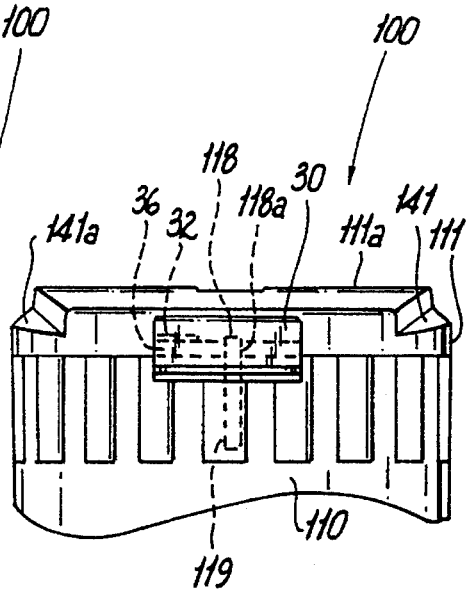
Fig. 18

COIN BOX RECEPTACLE

FIELD OF THE INVENTION

The present invention relates to a secure parking meter coin box assembly wherein a tamperproof seal with visual indicators is provided in a novel display portion of the coin box receptacle.

DESCRIPTION OF THE PRIOR ART

Various attempts have been made to secure coin boxes from tampering or loss due to theft. U.S. Pat. No. 4,194,775 of Shea describes a fastener for a pay telephone station coin box, wherein a strand is passed through a channel in a two piece fastener seal to lock a hasp in place upon the opening door plate of the coin box.

Moreover, Duncan Industries manufactures a parking meter with a cylindrical coin box therein, which is opened by a key. However, in the Duncan device, the cylindrical coin box is limited in volume, thus limiting the amount of revenue coins which may be accumulated between periodic retrieval of the coins from the parking meter. As a result, when a coin box is full, the subsequent coins fall outside of the coin box inside the parking meter head, thus making the coins available for pilfering when the parking meter is opened.

Other parking meters with coin box receptacles are described in U.S. Pat. Nos. 3,153,469 of McPherson, 3,770,090 of Fayling, 4,729,509 of Diekhoff and 5,184,707 of Van Horn. However, these coin boxes do not maximize interior coin collection volume and do not provide a coin box with a tamperproof seal with visual indicia displayed thereon.

Other parking meter related patents are described in U.S. Pat. No. 3,102,624 of Heyward; U.S. Pat. No. 3,118,597 of White; U.S. Pat. No. 3,126,995 of Arzt; U.S. Pat. No. 3,148,826 of Holder; U.S. Pat. No. 3,204,438 of Sollenberger; U.S. Pat. No. 3,231,180 of Wellekens; U.S. Pat. No. 3,419,209 of Munu; U.S. Pat. No. 3,920,112 of Guillot; U.S. Pat. No. 3,930,363 of Riebeisler; U.S. Pat. No. 3,961,744 of Kashuba; U.S. Pat. No. 3,964,590 of Cohee; U.S. Pat. No. 3,970,182 of Kiehl; U.S. Pat. No. 3,998,307 of Hammer; U.S. Pat. No. 3,999,372 of Fish; U.S. Pat. No. 4,183,205 of Kaiser; U.S. Pat. No. 4,195,471 of Verhoeven; U.S. Pat. No. 4,228,519 of Pfeifer; U.S. Pat. No. 4,297,683 of Roberts; U.S. Pat. No. 4,310,890 of Swahn; U.S. Pat. No. 4,607,739 of Kaiser; U.S. Pat. No. 4,717,007 of Van Horn; U.S. Pat. No. 4,730,285 of Lie; U.S. Pat. No. 4,786,787 of Matsumae; U.S. Pat. No. 4,792,032 of Shapiro; U.S. Pat. No. 4,798,273 of Ward; U.S. Pat. No. 4,807,737 of Herrmaan; U.S. Pat. No. 4,812,805 of Ferrus; U.S. Pat. No. 4,823,928 of Speas; U.S. Pat. No. 4,827,206 of Speas; U.S. Pat. No. 4,829,296 of Clark; U.S. Pat. No. 4,847,776 of Huany; U.S. Pat. No. 4,848,556 of Pester; U.S. Pat. No. 4,861,971 of Chan; U.S. Pat. No. 4,872,149 of Speas; U.S. Pat. No. 4,876,540 of Berton; U.S. Pat. No. 4,880,097 of Speas; U.S. Pat. No. 4,881,631 of Ward; U.S. Pat. No. 4,823,928 of Speas; U.S. Pat. No. 3,895,238 of Speas; U.S. Pat. No. 4,823,928 of Speas; U.S. Pat. No. 4,967,895 of Speas; U.S. Pat. No. 4,986,406 of Drew; U.S. Pat. No. 5,016,745 of Holzer; U.S. Pat. No. 5,029,094 of Wong; U.S. Pat. No. 5,065,156 of Bernien; U.S. Pat. No. 5,088,073 of Speas; U.S. Pat. No. 5,103,957 of Johanson; U.S. Pat. No. 5,131,516 of Clough; U.S. Pat. No. 5,135,096 of Ward; 5,166,680 of Ganot; U.S. Pat. No. 5,109,972 of Carmen; U.S. Pat. No. 5,184,707 of Carmen; U.S. Pat. No. 5,218,892 of Napoli; U.S. Pat. No. 5,244,070 of Carmen; U.S. Pat. No. 5,259,491 of Ward; U.S. Pat. No. 5,263,565 of Wilkerson; U.S. Pat. No. D336,860 of Clough; U.S. Pat. No. D342,209 of Clough; and U.S. Pat. No. RE 29,511 of Rubenstein.

Rubenstein '363 and Rubenstein RE 29,511 describe electronic parking meters, as do Speas '928, Speas '206, Speas '149, Speas, 097, Speas '238, Speas '895, Speas '745 and Speas '073. Other electronic related parking meters include Clark '296, Huany '776, Shah '556, Chan '971, Berthon '540, Ward '631, Wong '094, Bernier '156, Ng '957, Ganot '680, Ward '491, Wilkinson '565, Lie '285, Nawada '787, Welsh '372, Trehn '890, Verhoeven '471, Kaiser '205 and Lachat '805.

Patents which describe mechanical coin validating parking meters include Herrmann '737, Kaiser '739, Roberts '683, Pfeifer '519, Kolben '307, Kiehl '182, May '590, Kashuba '744, Guillot '112, Wilton '826, Munn '209, Shapiro '032, Van Horn '007, Van Horn '972, Carmen '070, Ward '096 and Schoeb '745.

Parking meter structural supports are described in Wellekens '180, Ward '273 and Winsor '406. Napoli '892 describes an accessory tool to service parking meters, and the two design patents of Clough '860 and Clough '209 describe ornamental shapes for parking meters. Clough '516 describes a parking ticket dispenser.

Moreover, Heywood '624, Kissinger '995, White '597 and Sollenberger '438 describe gear mechanisms for parking meters, but not retrofit coin boxes which maximize interior volume and not coin boxes with tamperproof seals with visual indicia displayed therein.

None of the prior art devices describe a coin box receptacle for a parking meter with a fiber optic tamperproof seal, wherein a display portion is provided on the exterior of the receptacle for visual observation of the seal and further wherein the coin box receptacle is retrofitted into a conventional parking meter housing head to maximize the interior volume for coin collection and to facilitate the easy removal of the sealed receptacle.

OBJECTS OF THE INVENTION

It is an object of the present invention to secure a parking meter coin box from tampering or loss due to theft.

It is a further object of the present invention to provide a parking meter coin box which maximizes volume, to increase the amount of revenue coins which may be accumulated between periodic retrieval of the coins from the parking meter.

It is yet another object to provide a parking meter coin box, which, when full, prevents any subsequent coins from falling outside of the coin box inside the parking meter head, thus reducing the number of coins available for pilfering when the parking meter is opened.

It is a further object to provide a parking meter coin box receptacle which can retrofit into an existing parking meter.

It is yet another object to provide a parking meter coin box which includes an exterior display pouch to hold and visually display a tamper proof seal therein.

It is yet another object to provide a parking meter coin box receptacle which includes an interior fastener, such as a rod, in positional register with the seal, wherein the bore of the seal accommodates a fiber optic strand within the seal fastener, to hold the locking rod in place and to indicate tampering when the fiber optic strand is cut.

It is yet another object to provide a seal with a bar code number corresponding to a bar code number on the outside of the coin box receptacle, so that the coin box receptacle and seal can be periodically tracked with a hand held scanner.

It is yet another object to provide a parking meter coin box receptacle which may be opened in a centrally located accounting location.

It is yet another object to provide a parking meter coin box which provides a visual indicia observable visually and by means of an optic scanner with a specially designed probe to fit around the pouch position of the receptacle.

It is yet a further object to provide a coin box receptacle which includes a novel mounting means for insertion of the coin box receptacle into a standard parking meter.

It is an object of the invention to provide a coin box receptacle which can be retrofit into existing parking meter head assemblies.

It is a further object to the present invention to provide a new coin box receptacle which replaces existing coin box receptacle without the need to change a conventional parking meter head assembly.

It is a further object to provide a parking meter coin box which is easy to unload, wherein the coins within the receptacle fall by gravity down the arcuate bottom wall and out of the coin box receptacle.

It is yet another object to improve over the disadvantages of the prior art.

SUMMARY OF THE INVENTION

The present invention includes a parking meter coin box receptacle which has a novel configuration to retrofit into an existing parking meter, while increasing the interior volume of the coin box receptacle, so that more coins can be accumulated between periodic emptying of the box.

Moreover, the coin box of the present invention includes a unique exterior display pouch to hold a seal, such as described in U.S. Pat. No. 4,194,775 of Shea, in a secure visible position, so that a fiber optic strand within the seal can be locked within a bore located within a seal fastener portion of an interior rod within the coin box receptacle. The interior rod is in positional register with the seal, and the bore accommodates the fiber optic strand within the seal fastener, to hold the locking rod in place, and to indicate tampering when the fiber optic strand is cut.

In addition, the seal is bar coded with a corresponding respective bar code number on the outside of the coin box receptacle, so that the coin box receptacle and the seal can be periodically tracked with a hand held scanner. Therefore, the seal fastener is integral with the interior rod of the coin box receptacle of the parking meter. The exterior display pouch of the coin box receptacle includes a front facing window, so that the bar code on the seal fastener can be easily viewed, while the seal fastener is in place, when the receptacle is removed, from a locked position within the parking meter.

The bar code of the coin box receptacle may also be recorded in a centrally located accounting location, wherein the seal fastener is placed within a jig, with a recess adjacent to the bored fastener head of the locking rod within the coin box receptacle. Then, the fiber optic strand is inserted within an arcuate channel within the seal fastener. Thus, the locking rod is held in place by the fiber optic strand, which, when broken, opens the seal when the rod is withdrawn, axially and longitudinally away from the seal, thereby severing the fiber optic strand, and providing an indicia observable both visually and by means of an optic scanner with a specially designed probe to fit around the pouch position of the receptacle.

Unlike in the seal fastener of U.S. Pat. No. 4,194,775 of Shea, wherein the seal fastener is mounted about the hasp on the exterior of the coin box, the display pouch portion of the present invention provides a better secure but visible opening for viewing the seal fastener.

The coin box receptacle of the present invention may include a novel mounting means for insertion of the receptacle into a parking meter. Vertical wall plates are placed within the parking meter head housing to facilitate a smooth sliding insertion of the coin box receptacle within the parking meter housing head. In addition, to further facilitate the insertion of the receptacle, the round door plate, instead of rotating down, is first moved forward upon a movable track, and then rotated horizontally to facilitate the insertion of the receptacle.

An alternate embodiment of the present invention includes a generally cylindrical coin box receptacle, which simplifies construction of existing coin box receptacles, by removing existing interior parts, while increasing the exterior volume to increase its capacity to hold coins.

In this alternate embodiment for a coin box receptacle, there is no need to retrofit the interior configuration of existing parking meter assemblies, since in this alternate embodiment, the coin box receptacle directly replaces existing cylindrical coin boxes without modification of the parking meter head assembly.

In comparison to the first embodiment, in this alternate embodiment of a coin box receptacle, the fiberoptic strand locks in an upwardly extending fixed mounting plate, which mounting plate is attached to the inside cylindrical wall of the alternate coin box receptacle, instead of to a movable interior rod of the first embodiment. The fixed mounting plate of the alternate embodiment, is preferably in the form of a "D"-ring, and it includes a bore, through which is inserted the fiberoptic strand of the fiberoptic seal, to hold the seal in place and to indicate tampering when the fiberoptic strand is cut.

DESCRIPTION OF THE DRAWING

The parking meter coin box assembly of the present invention may be best described in the accompanying drawings, in which:

FIG. 9 is a close up perspective view in partial section of the coin box coin input portion with a coin escape prevention means.

FIG. 10 is a close up sectional front view of the coin input portion as in FIG. 9.

FIG. 11 is a close up sectional view of an alternate coin input portion with an alternate coin escape prevention means.

FIG. 12 is a close up sectional front view of the alternate coin input portion as in FIG. 11.

FIG. 17 is an exploded perspective view of a coin box receptacle as in FIG. 16.

FIG. 18 is a close-up rear elevational view of the top portion of a coin box receptacle as in FIG. 16.

DETAILED DESCRIPTION OF THE PREFERRED EMBODIMENT

As shown in FIGS. 2–15, the present invention includes a novel coin box assembly for a parking meter 1.

Figure 1:
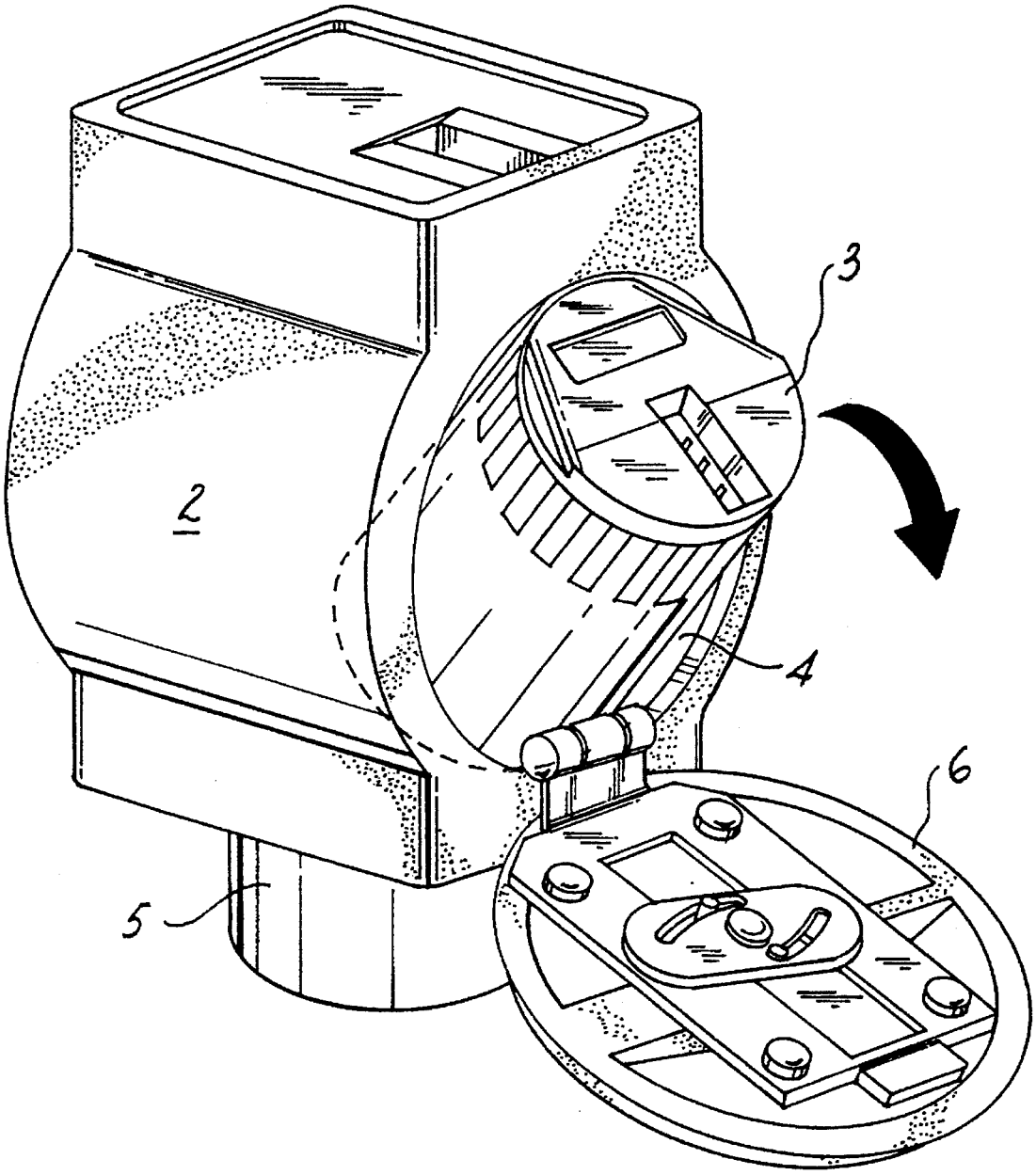
Fig. 1 (Prior Art)
FIG. 1 is a perspective view of a prior art meter and coin box.

FIG. 1 shows a prior art parking meter 2 and coin box 3, which coin box 3 is inserted in a recess 4 within parking meter 2, which parking meter 2 includes downwardly hinged door 6 and mounting post 5. Recess 4 in the prior art parking meter 2 is inefficient with respect to the coin collecting volume of coin box 3, since there is a considerable amount of wasted space surrounding coin box 3 within recess 4 of prior art parking meter 2.

Figure 2:
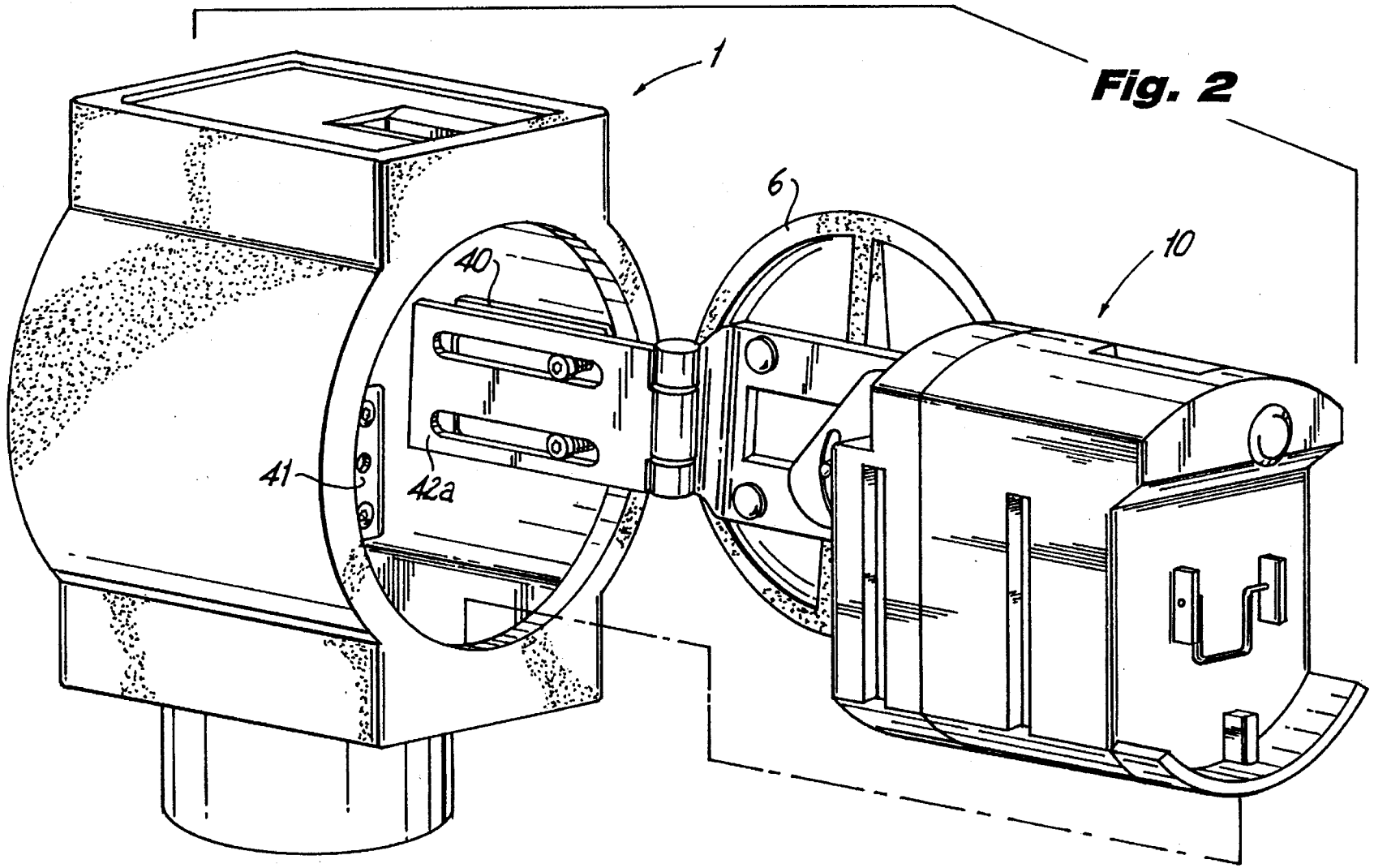
FIG. 2 is a perspective exploded view of the front of the new coin box receptacle and mounting assembly of the present invention.
Figure 3:
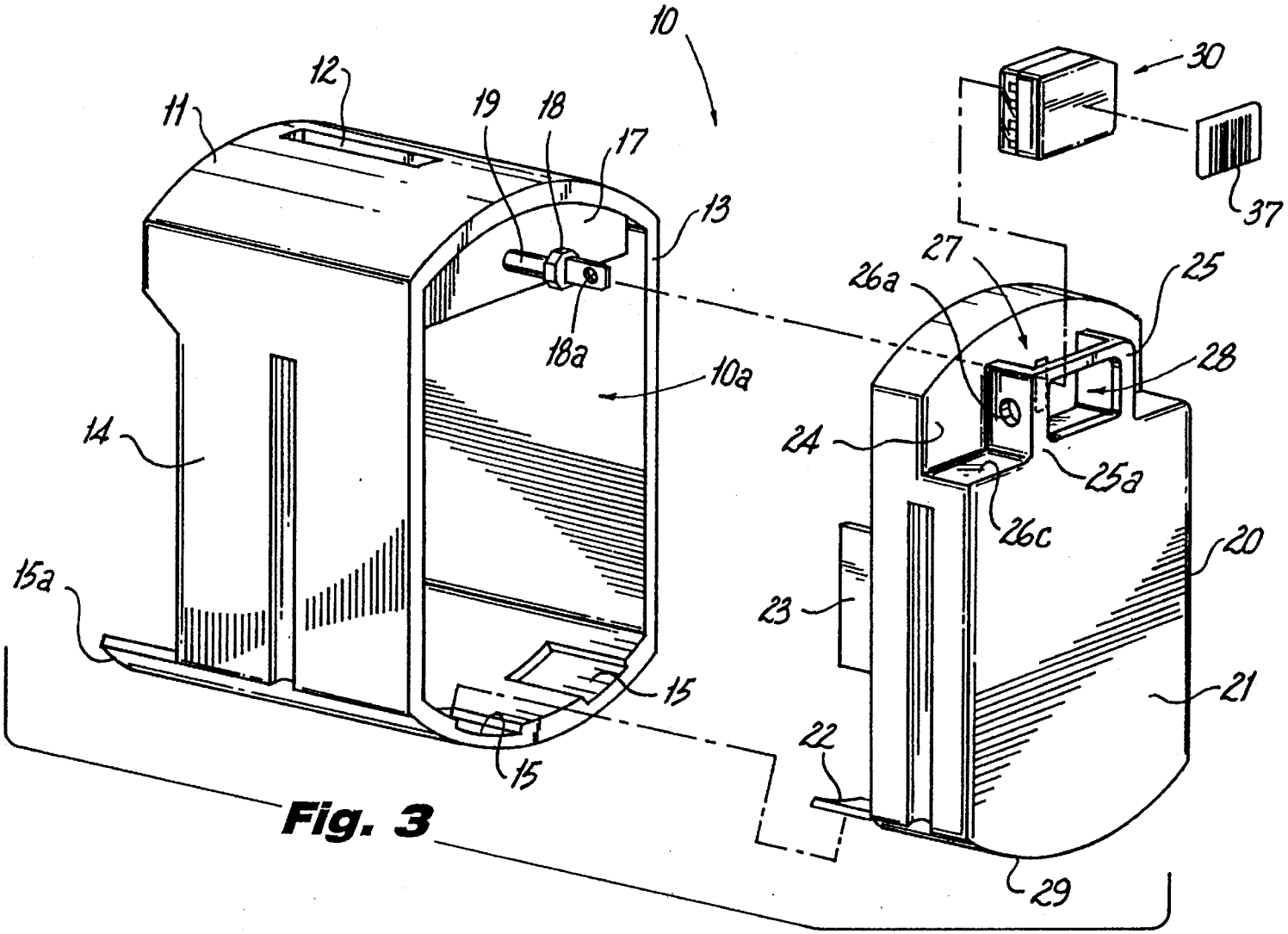
FIG. 3 is a perspective exploded view of the rear of the new coin box, wherein the code seal is pulled out and up.
Figure 5:
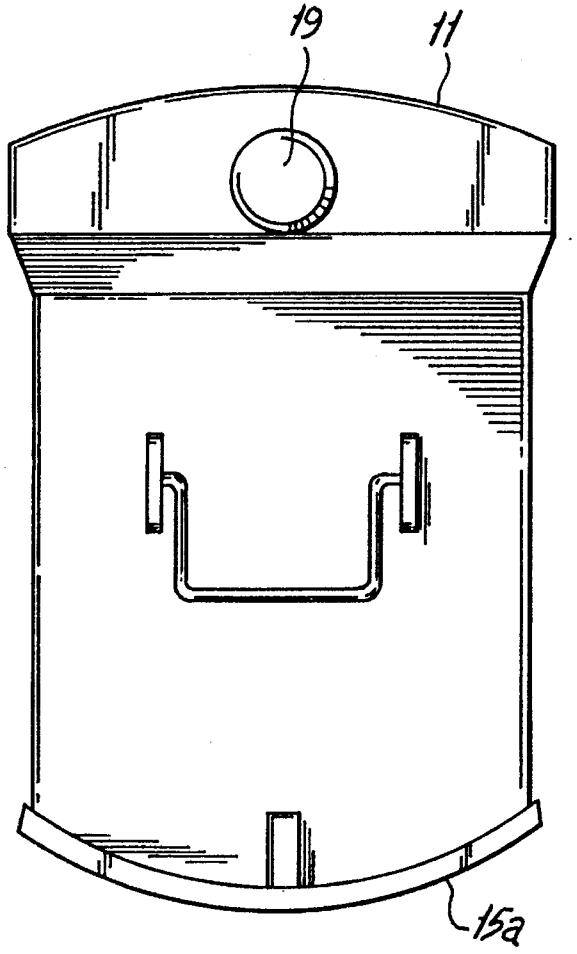
FIG. 5 is a front elevational view of the coin box.

FIGS. 2–6 show new coin box 10, and its mounting assembly, of the present invention. As shown in FIG. 3, bar coded seal element 30 is removably insertable within display portion 25 of front plate 20 of coin box 10.

Figure 7:
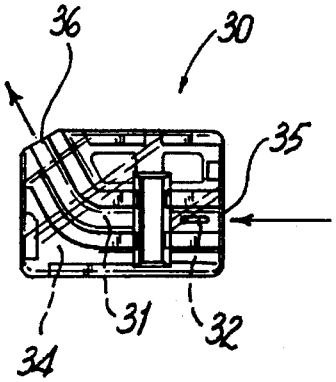
Fig. 7 (Prior Art)
FIG. 7 is an elevational view of a fiber optic seal, showing, light tube, for use with the coin box as in FIG. 2.

Coin box 10 includes a rod 19, such as a bolt, having seal interruption fastener means 18. Seal interruption fastener means 18 includes a transverse bore 18*a*, which bore 18*a* is in communication with fiber optic strand 36 of seal 30, as shown in FIG. 7. Coin box 10 also includes shunt 12 as a coin slot for incoming coins. Seal 30 includes a channel 32, such as an arcuate light tube, wherein fiber optic strand 36 is slidably movable.

Fiber optic strand 36 is inserted through bore 18*a* of seal interruption fastener means 18, and then within arcuate channel 32 within seal 30. When rod 19 is pulled axially away from seal 30, then seal interruption fastener means 18 breaks fiber optic strand 36 within bore 18*a* of seal interruption fastener means 18.

Thus, seal interruption fastener means 18 of locking rod 19 is held in place by fiber optic strand 36, which, when broken, opens seal 30 when rod 19 is withdrawn axially and longitudinally away from seal 30, thereby severing fiber optic strand 36 and providing a visual indicia observable visually, and by means of optic scanner 50, with a specially designed probe 53, to fit around display portion 25 of coin box receptacle 10.

Display portion 25, having window 28, of coin box receptacle 10 provides a better opening for viewing seal 30.

Figure 8:
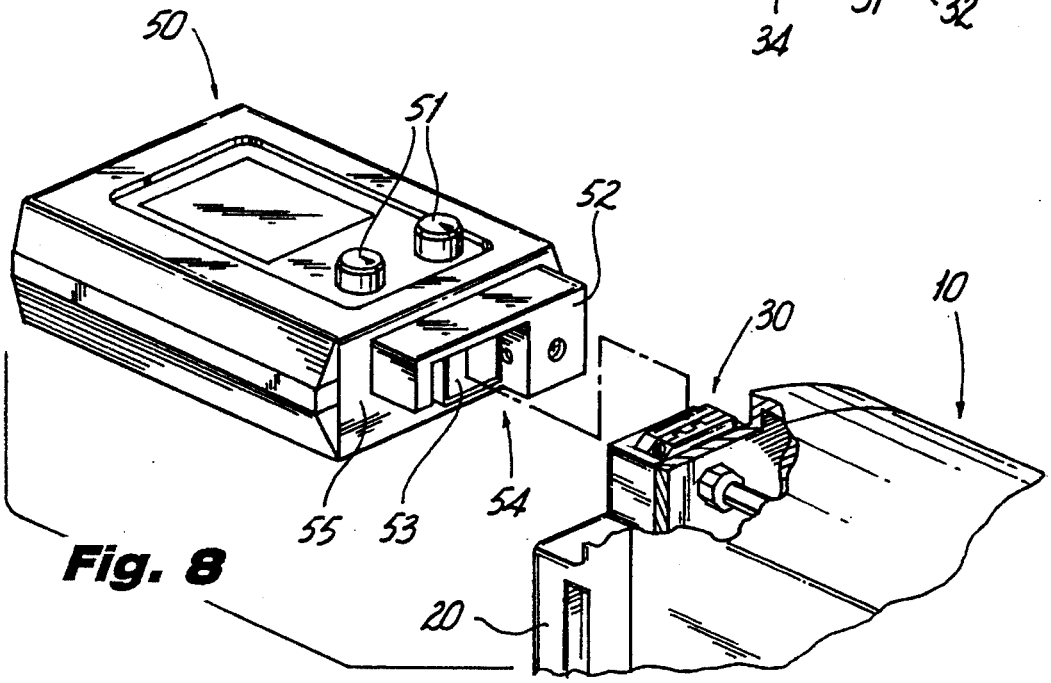
FIG. 8 is a perspective view of a scanner, adjacent to the fiber optic seal as in FIG. 7.

As shown in FIG. 8, seal 30 may be read in the field by scanner 50, with indicator lights 51 adjacent to probe end 53, which probe end 53 is placed near fiber optic seal 30, as shown in FIG. 8. For accurate placement, probe end 53 is surrounded by upside down U-shaped collar 52, having collar recess 54 therein, for insertion of fiber optic seal 30 therein.

As shown in FIGS. 2 and 3, coin box receptacle 10 slidably fits between vertical mounting walls 40, 41 within parking meter 1 for insertion of coin box receptacle 10 into parking meter 1. Vertical wall plates 40, 41 are placed within parking meter 1 to facilitate sliding insertion of coin box receptacle 10 within parking meter 1. In addition, to further facilitate the insertion of coin box receptacle 10, round door plate 42, instead of rotating down, is first moved forward upon a movable brace 42*a* upon track 42*b* of plate 40, and then rotated horizontally to facilitate the insertion of coin box receptacle 10 within parking meter 1.

Figure 13:
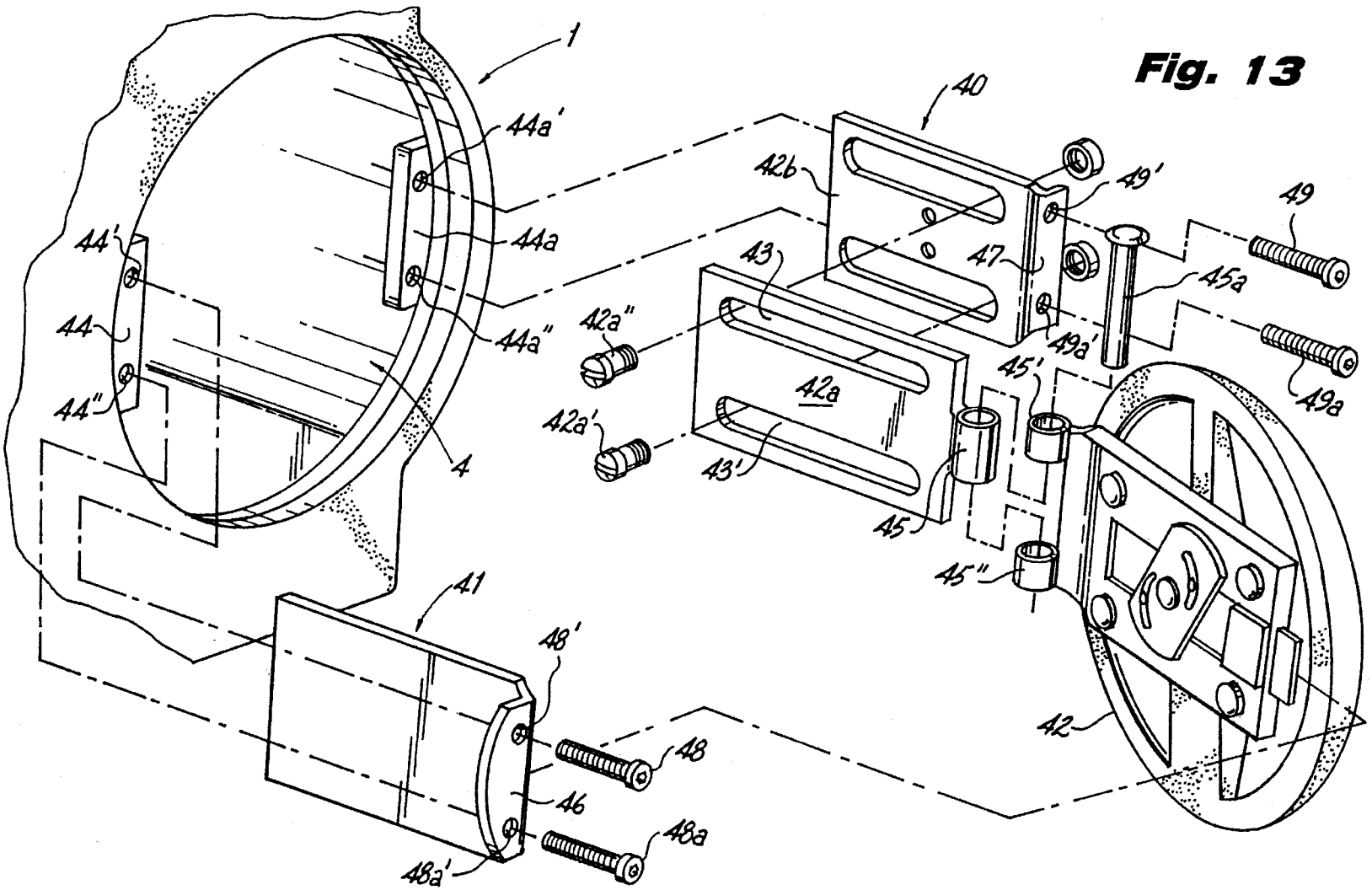
FIG. 13 is an exploded perspective view of the mounting assembly as in FIG. 2.

FIG. 13 shows parking meter 1 with retrofit side wall elements 40, 41, which are placed vertically within parking meter 1. Side wall element 40 includes fixed wall element 42*b* attached by bracket 47 to parking meter bracket 44*a* by fasteners, such as bolts 49, 49*a*, within bores 44*a'*, 44*a*" of bracket 44*a* and bores 49', 49*a'* of bracket 47. Further fixed wall element 41 is attached to parking meter 1 with fasteners, such as bolts 48, 48*a* through bores 48', 48*a'* of bracket 46 and bores 44' 44" of bracket 44.

Unlike bottom opening door 6 of prior art meter 2, door 42 is re-oriented to open sideways and outwards, since movable wall 42*a* slidably moves horizontally about a track including pins 42*a'*, 42*a*" by means of recesses 43, 43' of movable wall 42*a*. Door 42 therefore moves outward away from parking meter 1 to facilitate the convenient installation or removal of coin box 10 within parking meter 1. Door 42 opens about hinge rod 45*a* within collar 45 of movable wall 42*a* and collars 45', 45" of door 42.

As further shown in FIG. 3, coin box 10 is secured from tampering or loss due to theft by insertion of prior art fiber optic seal 30 within coin box 10, wherein strand 36 is passed through channel 32 to lock seal 30 in place within the novel mounting display portion 25 upon the plate 20 of coin box 10.

As shown in FIGS. 2 and 13, coin box 10 is retrofitted to maximize its coin receptacle volume within parking meter 1, thus increasing the amount of revenue coins which may be accumulated between periodic retrieval of the coins from parking meter 1. To maximize interior volume, coin box 10 includes concave arcuate top 11, having shunt opening 12, for insertion of coins therein, as well as side walls 13, 14 and concave, arcuate bottom wall 15. One side is closed by front plate 10*a*, and an opposite side is closed by rear plate 20.

Rod 19, having seal interruption fastener means 18, is inserted through support member 17 of coin box 10 for communication with seal 30, having fiber optic strand 36, within channel 32, of seal 30, and bore 18*a* of seal interruption means 18.

Figure 4:
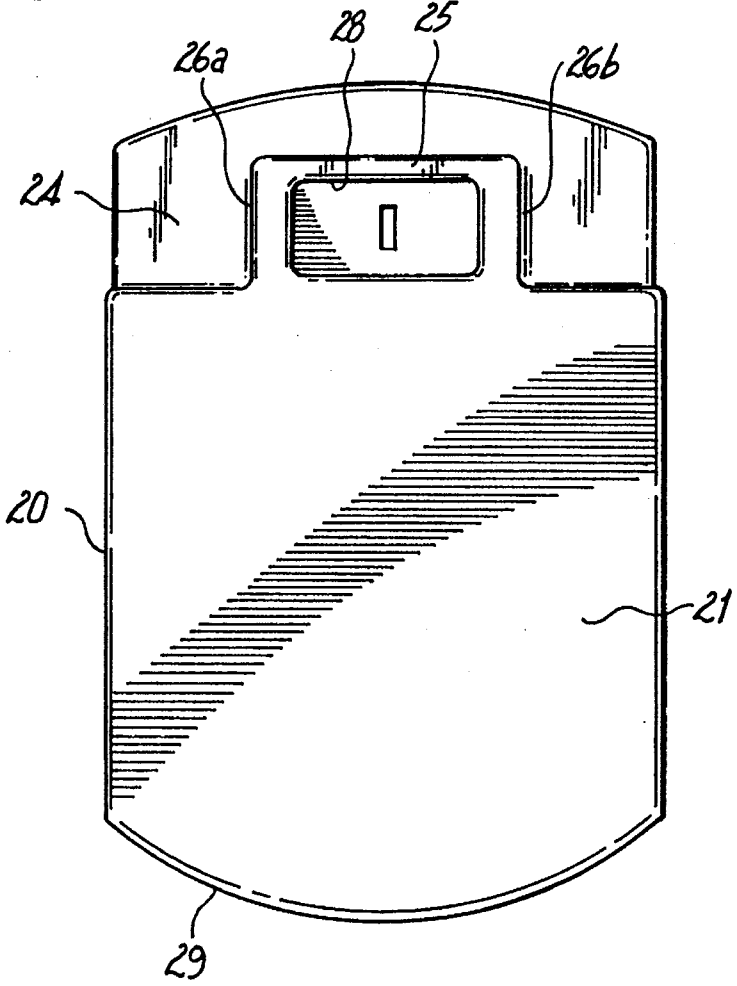
FIG. 4 is a rear elevational view of the coin box with a pouch for the seal.
Figure 6:
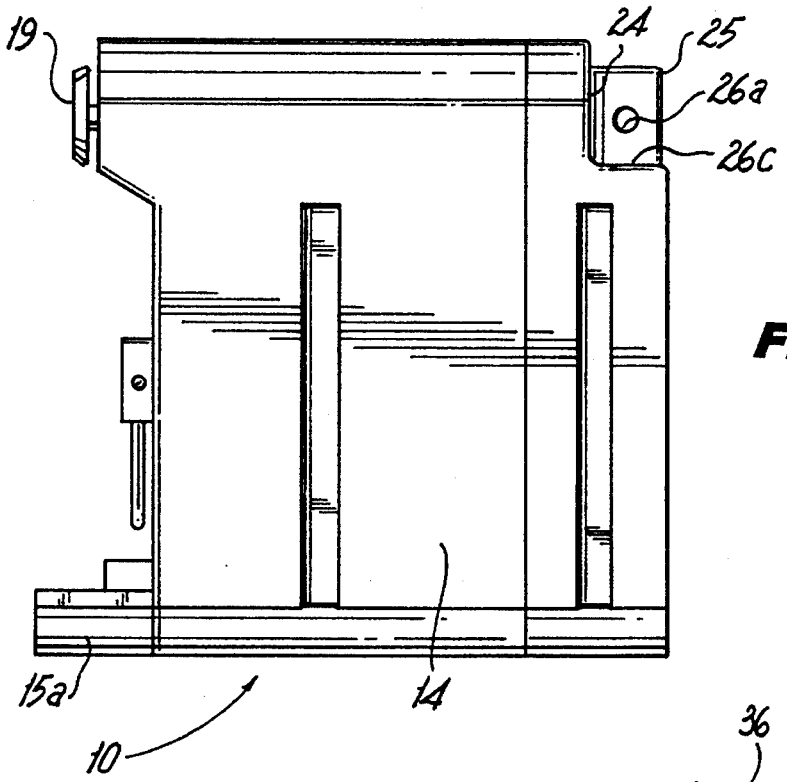
FIG. 6 is a side elevational view of the coin box.

As shown in FIGS. 2–4, to provide a visible display of seal 30, coin box 10 of the present invention includes unique exterior pouch display portion 25 to hold seal 30 in a secure position for locking with seal interruption fastener means 18 of interior locking rod 19 within coin box receptacle 10. Interior rod 19 is in positional register with seal 30, and seal 30 accommodates fiber optic strand 36 within arcuate channel 32, to hold locking rod 19 in place and to indicate tampering when fiber optic strand 36 is cut by movement of locking rod 19 away from fiber optic strand 36 of seal 30.

Display portion 25 constitutes a top open pouch with recess 27 therein for insertion of seal 30. Display portion 25 includes side walls 26*a*, 26*b* and front wall 25*a* having viewing window 28. Display portion 25 is mounted flush to front wall 21 of coin box plate 21 and at its rear, to auxiliary wall 24 of plate 20. Shoulders 26*c*, 26*d* position display portion 25 centrally upon plate 21.

As shown in FIG. 3, seal 30 is bar coded with a corresponding respective bar code number 37 to a bar code number on outside front 25*a* of display portion 25 of the coin box receptacle 10, so that coin box receptacle 10 and seal 30 can be periodically tracked with hand held scanner 50, when coin box receptacle 10 is removed from parking meter 1.

Display portion 20 for seal 30 is integral with coin box receptacle 10 of parking meter 1. Display portion 25 is an exterior pouch for the coin box receptacle 10 and display portion 25 includes a front facing viewing window 28, so that bar code 37 on seal 30 can be easily viewed when coin box receptacle 10 is removed from the parking meter for coin collection as noted before. Seal 30 is held in place in a locked position within the parking meter coin box and display portion 25 of receptacle 20.

Figure 15:
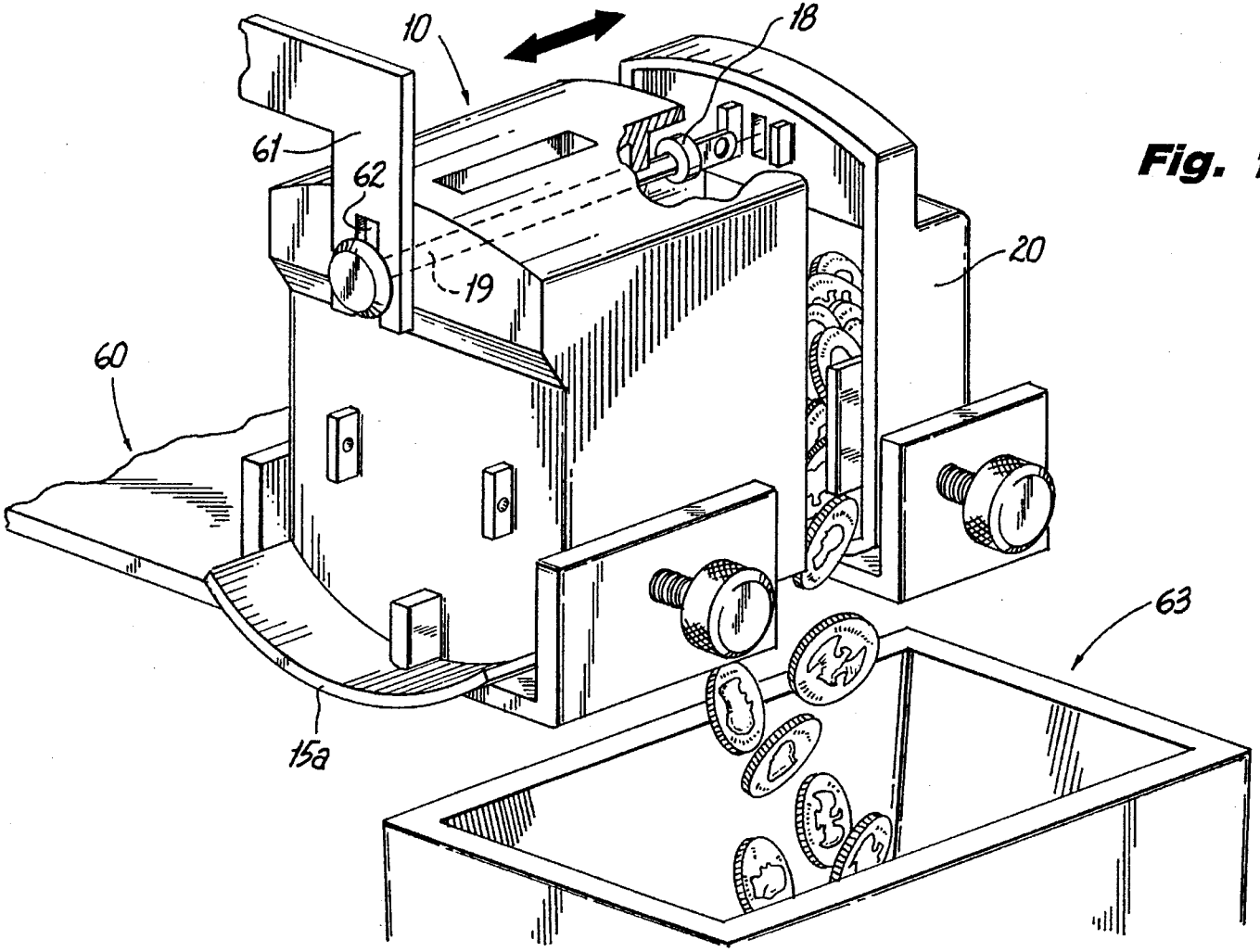
FIG. 15 is a perspective view of an alternate holding means for unloading the coin box receptacle at a remote location.
Figure 16:
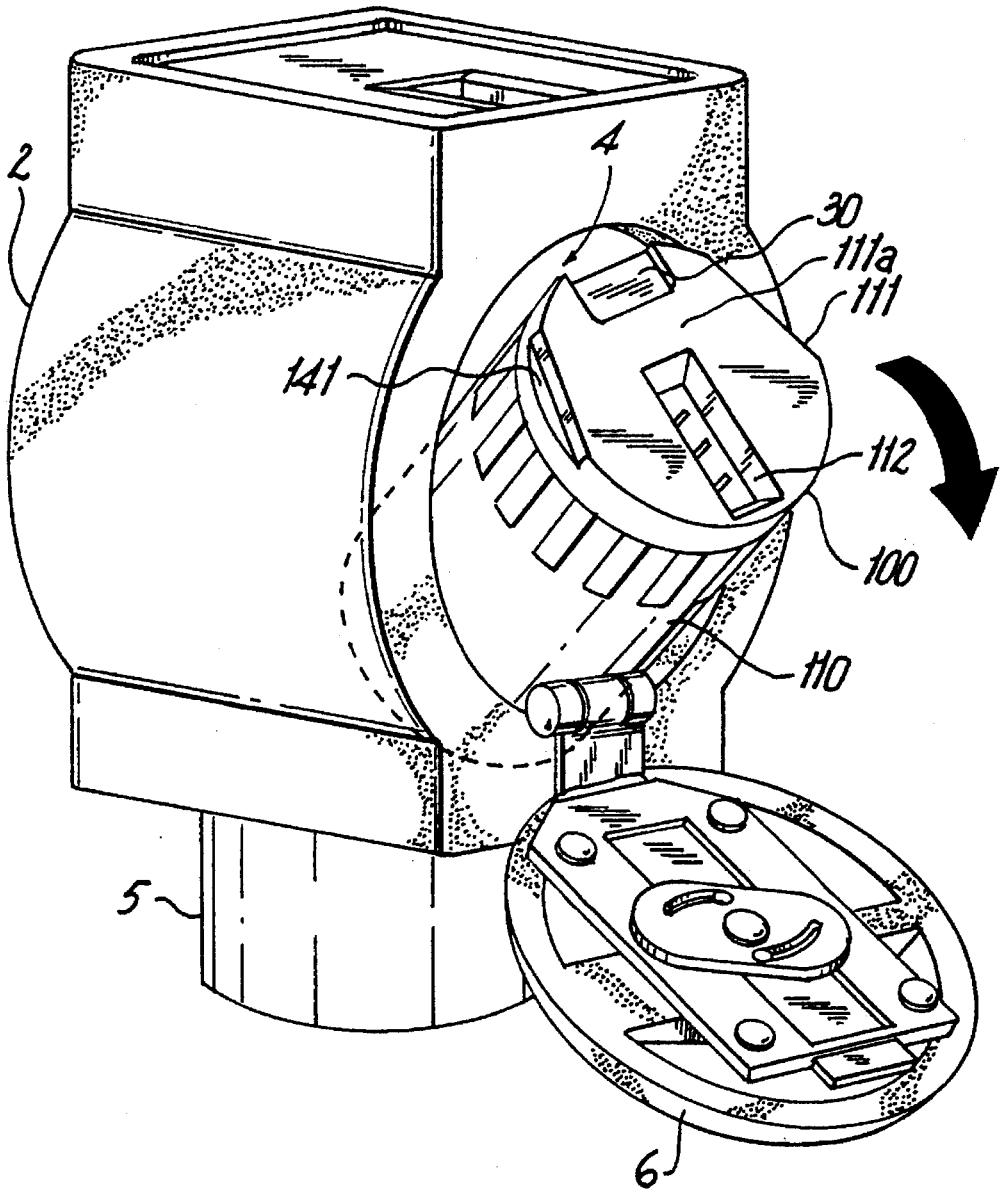
FIG. 16 is a perspective view of an alternate coin box receptacle.

As shown in FIG. 15, coin box receptacle 20 may also be recorded in a centrally located accounting location, wherein seal 30 is placed within a jig 60 with arm 61 having recess adjacent to locking rod 19 within coin box receptacle 10. When arm 61 is withdrawn, front plate 20 separates from coin box 10, causing coins to be released to collection bin 63.

Figure 14:
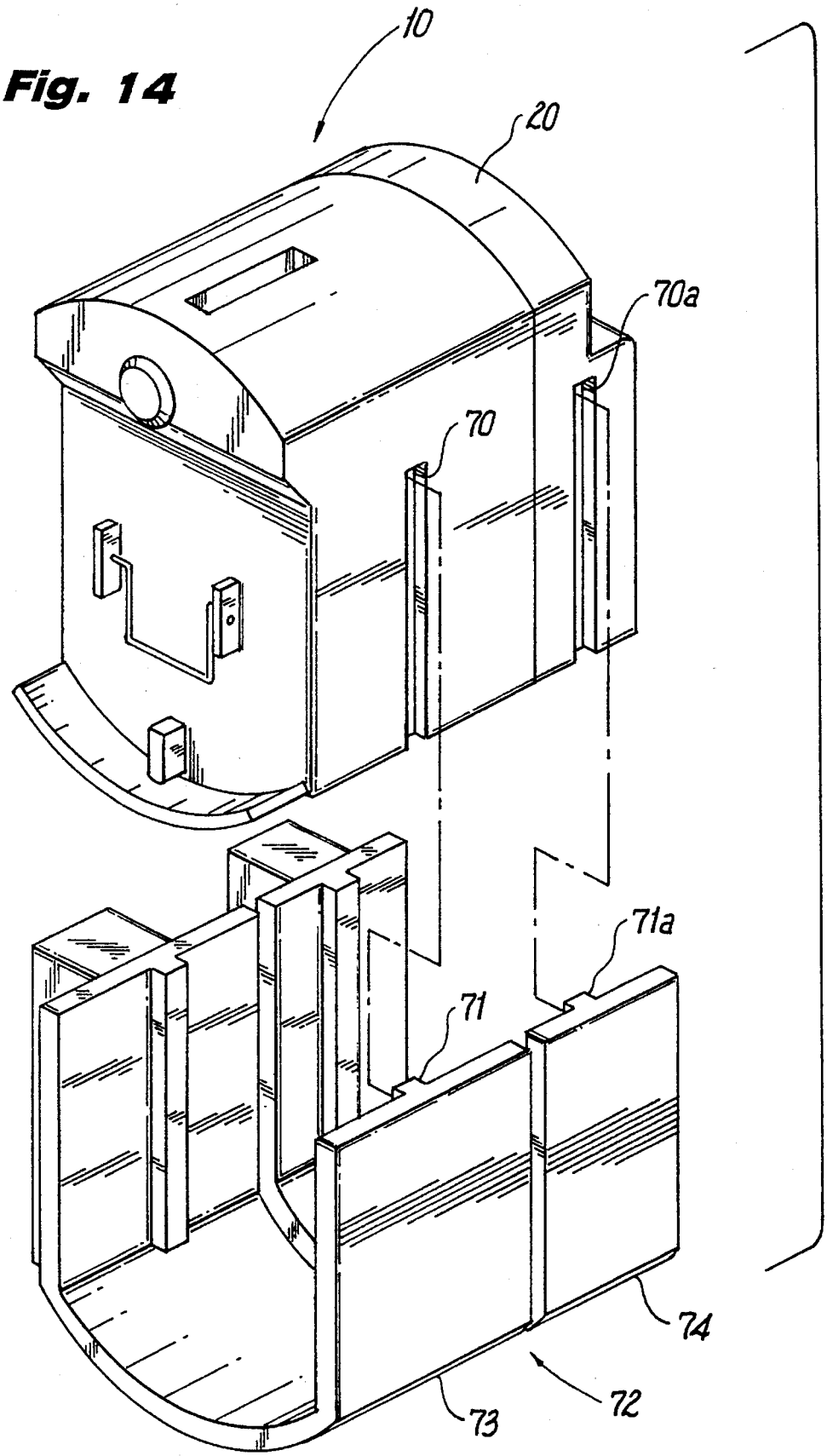
FIG. 14 is a perspective view of a holding means for unloading the coin box receptacle at a remote location.

Alternately, as shown in FIG. 14, coin box 10 may be provided with detents 70, 70*a* on each side thereof, wherein the longitudinally extending protrusions 71, 71*a* of jig 72 slidably fit within detents 70, 70*a* of coin box 10. Jig 72 includes separable holding parts 73, 74 to separate and remove rear plate 20 from coin box 10 to release coins therefrom.

In addition, coin box receptacle 10 has an arcuate bottom portion 29, so that when face plate 20 of coin box receptacle 10 is pulled forward away from the body of coin box receptacle 10, thus exposing the interior 10*a* of coin box receptacle 10, the coins within coin box receptacle 10 fall by gravity down the arcuate bottom wall portion 29 and out of coin box receptacle 10.

As shown in FIGS. 9 and 10, to prevent tampering and premature theft of coins from coin box 10, shunt opening coin slot 12 may be provided with shunt 12*a* having closure means such as rotatable flaps 12*b*, 12*b*', 12*b*" which pivot to permit incoming coins to pass through shunt 12*a* into coin box 10. Shunt 12*a* is located within coin box 10 in the vicinity of rod 19.

As shown in FIGS. 11 and 12, an alternate anti-theft device includes closure means such as movable claw element pairs 12*c*, 12*d*, 12*c*', 12*d*' and 12*c*", 12*d*", which open when an incoming coin comes through, and which stay closed as in FIG. 12 to prevent coins from being shaken out of shunt opening 12.

As shown in FIGS. 17 to 19, an alternate coin box receptacle 100 includes a generally cylindrical body 110, and a generally cylindrical cap cover 111, which cap cover 111 is removable from cylindrical body 110 of alternate coin box 100. Alternate coin box receptacle 100 is inserted within the conventional recess 4 of a prior art parking meter 2, which parking meter 2 includes downwardly hinged door 6 and mounting post 5, as shown in FIG. 1.

Cap cover portion 111 of alternate coin box receptacle 100 includes shunt 112 extending therethrough as a coin slot for incoming coins. Attached to interior wall 110*a* of cylindrical body 110 of coin box 100 is provided an upwardly extending plate member 119 having a seal interruption fastener means 118 with a transverse bore 118*a* extending therethrough. Preferably, seal interruption fastener means 118 is in the shape of a "D" ring. Seal interruption fastener means 118 is placed in communication with the prior art fiber optic seal 30, as shown in FIG. 7, which seal 30 includes fiberoptic strand 36, extending through arcuate channel 32 of seal 30. Fiber optic strand 36 is received within bore 118*a* of seal interruption means 118 of alternate coin box receptacle 100.

It is further noted that shunt 112 may be provided with closure means shown in FIGS. 9–12 with respect to shunt 12 of coin box 10.

Removable cap cover portion 111 of alternate coin box receptacle 100 includes a cut out recess 128 of outwardly facing window display portion 125 so that fiberoptic seal 30 may be inserted and visually observed within cut out recess 128. Plate member 119 of coin box receptacle body 110 extends upward into recess portion 128, so that the fiberoptic seal 30 may be placed in communication with seal interruption fastener means 118 of plate member 119.

As noted previously, prior art fiber optic seal 30 includes hollow light tube 32, through which fiberoptic strand 36 is slidably movable.

Fiberoptic strand 36 is maintained in a secure position through bore 118*a* of seal interruption fastener means 118, so that when coin box receptacle 100 is tampered with, fiberoptic strand 36 opens seal 30. When seal 30 has been tampered with, fiberoptic strand 36 is severed, thus providing a visual indicia observable by means of the placement of optic scanner 30 at window display portion 125 to observe that fiberoptic strand 36 has been severed and coin box receptacle 100 has been tampered with.

Since alternate coin box receptacle 100 is similar in cylindrical shape to prior art coin box 3, it can be inserted conventionally within recess 4 of prior art parking meter head 2 in a manner similar to that shown in FIG. 1, which depicts the prior art receptacle 3 being insertable within parking meter head 2.

The existing interior parts of the prior art coin box receptacle 3 are removed in constructing alternate coin box receptacle 100, thus increasing its interior volume and its capacity to store more coins.

To place alternate coin box receptacle 100 within conventional prior art parking meter head assembly 2, cap cover portion 111 further includes truncated recesses 141, 141*a*, which truncated recesses 141, 141*a* are built into top portion 111*a* of cap cover 111, so that alternate coin box receptacle 100 can be inserted within existing parking meters 2.

The benefit of the alternate embodiment shown in coin box receptacle 100 is that it does not require the retrofitting of conventional parking meter 2 with the auxiliary interior housing track assembly shown in FIGS. 2 and 13. Therefore, alternate coin box receptacle 100 completely replaces conventional prior art coin box receptacle 3, without any structural modifications of conventional parking meter head assembly 2.

Other modifications may be made to the parking meter assembly of the present invention, without departing from the scope of the appended claims.

I claim:

1. A parking meter assembly to secure a coin box therein from tampering or loss due to theft, comprising a coin box receptacle insertable within a parking meter, a seal for said coin box, said seal having a fiber optic strand within a channel within said seal to lock a fastener of said coin box in place, said coin box including an exterior display portion holding said seal therein in a secure position for locking with said fastener within an interior of said coin box, said fastener being in positional register with said seal, said display portion of said coin box of the parking meter including a visible window, so that said seal can be easily viewed while said seal and said fastener are in the locked position, said fastener being in communication with said fiber optic strand, for opening said seal when said fastener is withdrawn, axially and longitudinally away from said seal, thereby severing said fiber optic strand.

2. The coin box as in claim 1, further comprising a novel mounting means for insertion of said coin box into the parking meter, said mounting means including at least one vertical wall plate within the parking meter to facilitate sliding insertion of said coin box within the parking meter, a door plate movable forward about a movable track, said door plate rotatable horizontally to facilitate the insertion of said coin box within the parking meter.

3. The coin box as in claim 1, further comprising an arcuate bottom portion, so that when the face plate of the receptacle is pulled forward of the body of the receptacle, thus exposing the interior of the receptacle, the coins within said coin box, fall by gravity down the arcuate bottom wall and out of said coin box.

4. The parking meter assembly as in claim 1, further comprising a means to retrofit said coin box into the parking meter while increasing the interior volume of the coin box receptacle, so that more coins can be accumulated between periodic emptying of the box, said means comprising an arcuate top portion and an arcuate bottom portion of said coin box.

5. The parking meter assembly, as in claim 1, wherein said seal is bar coded with a corresponding respective bar code number on the outside of said coin box, said parking meter assembly having a hand held scanner with a probe responsive to said bar codes.

6. The fastener as in claim 1 further comprising a seal interruption means including a bore for insertion for said fiber optic strand therein, said fastener responsive to breaking said fiber optic strand when said fastener is withdrawn away from said seal.

7. The coin box as in claim 1, further comprising an anti-theft means including rotatable closure means responsive to opening upon insertion of coins within said coin box and responsive to closing after the coin has passed said closure means.

8. A parking meter assembly to secure a coin box therein from tampering or loss due to theft, comprising a coin box receptacle insertable within a parking meter, said coin box receptacle comprising a coin box body for receiving coins therein, and a removable cap cover engagable with said coin box body, said cap cover having a shunt opening for insertion of coins therethrough into said coin box body, a seal being insertable within a cap cover of said coin box receptacle, said seal having a fiber optic strand within a channel within said seal, said fiber optic strand engagable with seal interruption fastener, said fastener extending upward from an inside surface of said coin box receptacle, said cap cover of said coin box receptacle further including an exterior display portion, said seal insertable within said exterior display in a secure position for locking with said fastener, said fastener being in positional register with said seal, said display portion of said cap cover of said coin box receptacle including a visible window, so that said seal can be easily viewed while said seal and said fastener are in the locked position, said fastener being in communication with said fiber optic strand, for opening said seal when said coin box body is withdrawn, axially and longitudinally away from said cap cover, thereby severing said fiber optic strand of said seal within said display portion of said cap cover.

9. The fastener as in claim 8 further comprising a bore for insertion of said fiber optic strand therein, said fastener responsive to breaking said fiber optic strand when said fastener is withdrawn away from said seal.

* * * * *